US005966811A

United States Patent [19]

Zalusky

[11] Patent Number: 5,966,811

[45] Date of Patent: Oct. 19, 1999

[54] TWIST 'N' CURL

[76] Inventor: Donna Zalusky, P.O. Box 28248, Washington, D.C. 20038

[21] Appl. No.: 09/273,470

[22] Filed: Mar. 22, 1999

Related U.S. Application Data

[60] Provisional application No. 60/081,927, Apr. 16, 1998.

[51] Int. Cl.[6] ..... B21F 43/00; B21F 3/00

[52] U.S. Cl. ..... 29/896.4; 29/896.9; 59/83; 59/92; 63/5.2; 140/124

[58] Field of Search ..... 29/433, 896.4, 29/896.41, 896.411, 896.9; 59/83, 92; 63/3, 4, 5, 2; 140/71.5, 124

[56] References Cited

U.S. PATENT DOCUMENTS 758,829 5/1904 Dodd .
1,253,782 1/1918 Bryan .
2,218,345 10/1940 Spaeth ..... 140/71.5
2,530,576 11/1950 Gregory .

FOREIGN PATENT DOCUMENTS 579426 7/1989 Canada ..... 140/71.5
2634097 11/1977 Germany ..... 140/124

*Primary Examiner*—P. W. Echols
*Attorney, Agent, or Firm*—Patent & Trademark Services; Joseph H. McGlynn

[57] ABSTRACT

A method of using a wire twisting tool for making jewelry, in which a T-shaped tool having a handle is attached to a shaft. The handle has an aperture for receiving the end of a wire and the handle is used to twist the wire about the shaft to form a curled, coiled spring type formation. The first spring type formation is then removed from the tool and a second wire is attached to the tool and curled within the first spring type formation to form jewelry and other items.

2 Claims, 1 Drawing Sheet

TWIST 'N' CURL

This is a conversion of Provisional Ser. No. 60/081,927, filed Apr. 16, 1998.

BACKGROUND OF THE INVENTION

This invention relates, in general, to jewelry making tools, and, in particular, to a method of making jewelry using a particular tool.

DESCRIPTION OF THE PRIOR ART

In the prior art various types of wire twisting tools have been proposed. For example, U.S. Pat. No. 758,829 to Dodd discloses a wire working tool having a horizontal member with an aperture for receiving an end of the wire to be twisted.

U.S. Pat. No. 1,253,782 to Bryan discloses a coil forming machine which has a first member around which the wire is wrapped, and a second member at a right angle to the first member. The second member has an aperture to receive an end of the wire and turning the second member coils the wire around the first member.

U.S. Pat. No. 2,530,576 to Gregory discloses a spring winder which has a first member around which the wire is wrapped, and a second member at a right angle to the first member. The second member has an aperture to receive an end of the wire and turning the first member coils the wire around the first member.

SUMMARY OF THE INVENTION

The present invention is directed to a method of using a wire twisting tool for making jewelry, in which a T-shaped tool having a handle is attached to a shaft. The handle has an aperture for receiving the end of a wire and the handle is used to twist the wire about the shaft to form a curled, coiled spring type formation. The first spring type formation is then removed from the tool and a second wire is attached to the tool and curled within the first spring type formation to form jewelry and other items.

It is an object of the present invention to provide a new and improved method of forming jewelry.

It is an object of the present invention to provide a new and improved method of forming jewelry that can be performed by anyone.

It is an object of the present invention to provide a new and improved method of forming jewelry that is inexpensive and is not time intensive.

These and other objects and advantages of the present invention will be fully apparent from the following description, when taken in connection with the annexed drawings.

DESCRIPTION OF THE PREFERRED EMBODIMENT

Figure 1:
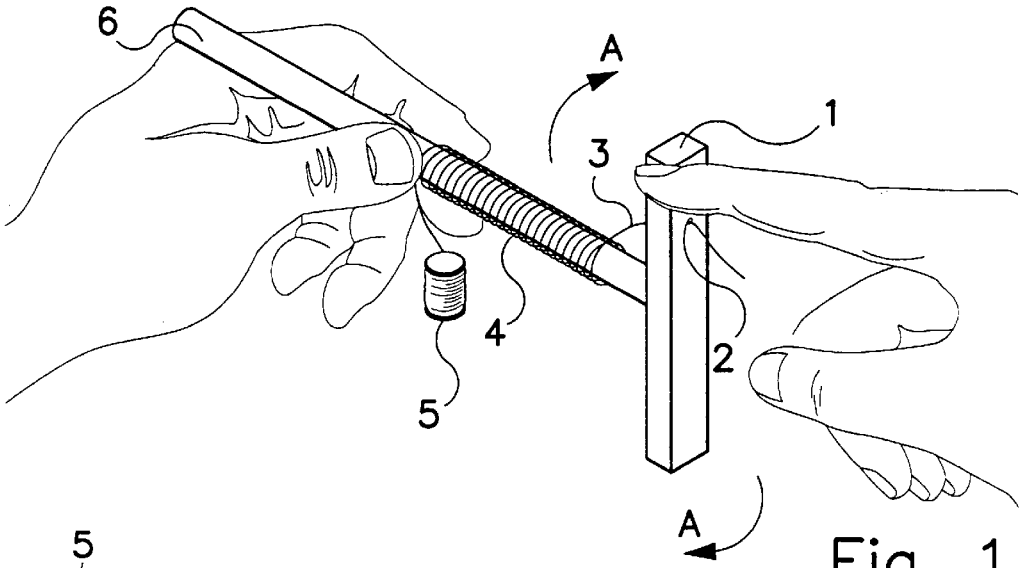
FIG. 1 is a view of the tool used with the first step of the method of the present invention.

Referring now to the drawings in greater detail, FIG. 1 shows the first step used to make jewelry using the tool of the present invention. The tool comprises a stem piece 6 which is attached, either permanently or detachably, to a handle 1. The handle 1 has an aperture 2 extending therethrough at a position closely adjacent the joint between the handle 1 and the stem piece 6.

The first step in the method of using the tool is shown in FIG. 1, and comprises pulling a portion of wire 3 from a spool of wire 5. The end of the wire 3 is passed through the aperture 2 in the handle 1. Then the handle is turned in the direction of the arrows A to twist the wire around the stem piece 6 to form a spring like spiral 4 as shown in FIG. 1.

Figure 2:
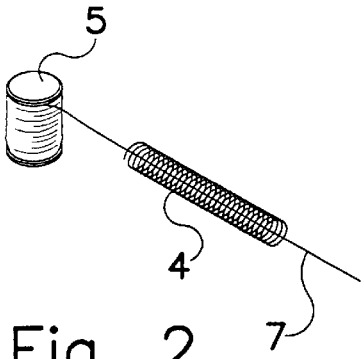
FIG. 2 is a view showing the second step of the method of the present invention.
Figure 3:
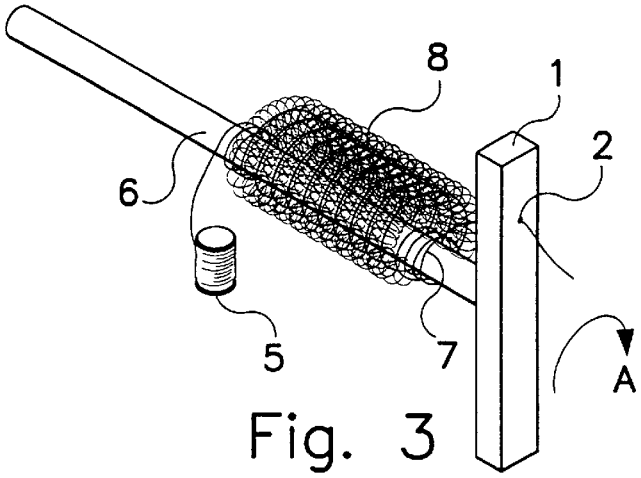
FIG. 3 is a view of the third step of the method of the present invention.

The spiral 4 is then removed from the stem piece 6 and cut from the rest of the wire remaining on the spool 5. Next, more wire is pulled from the spool 5 and passed through the longitudinal center of the spring like spiral 4 as shown at 7 in FIG. 2. The wire 7 is then passed through the aperture 2 in the handle 1, as shown in FIG. 3, and the handle is again twisted in the direction shown by the arrow A in FIG. 3. This will form a second spring like spiral, and at the same time will further curl the first spring like spiral 4 into a second curl as shown at 8 in FIG. 3.

Figure 4:
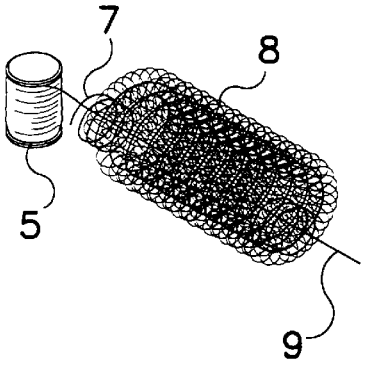
FIG. 4 is a view of the fourth step of the method of the present invention.
Figure 5:
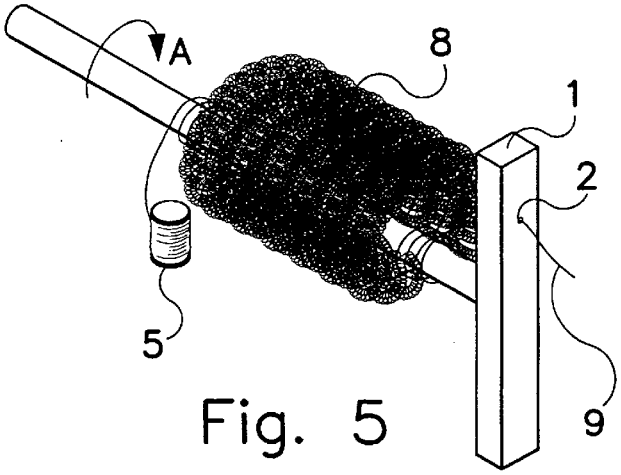
FIG. 5 is a view of the fifth step of the method of the present invention.

Depending on the type of jewelry being made, the user can stop at this point, having just made a simple "bead" and this piece can be used to fashion a jewelry piece. If the user desires to make a more complicated piece of jewelry, a complex bead can be formed by pulling more wire, as shown at 9 from the spool 5 (see FIG. 4) and passing this piece of wire through the longitudinal center of the spiral 8, that was just made, as shown in FIG. 4. Next, the end of the wire 9 is passed through the aperture 2 in the handle 1 and the handle will be turned in the direction of the arrow A. This will form a more complex bead since the spiral 8 will be twisted at the same time that the wire 9 is being twisted by the handle 1 and the stem 6. This process can be repeated as many times as necessary in order to form as many beads as desired.

Although the Twist 'N' Curl and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A method of making jewelry using a twisting tool which comprises a stem piece joined at a right angle to a handle, and the handle has an aperture therethrough, and the method comprises:

inserting an end piece of wire into said aperture in said handle, holding said piece of wire closely adjacent said stem piece, and rotating said handle to curl said wire around said stem piece to form a first spiral, removing said first spiral from said tool, inserting a second piece of wire through the longitudinal center of said first spiral, inserting an end piece of said second piece of wire through said aperture in said handle, rotating said handle to curl said second piece of wire around said stem piece, and at the same time curl said first spiral around said stem piece to form a second spiral, removing said second spiral from said tool.

2. The method of making jewelry as claimed in claim 1, wherein said method additionally comprises:

inserting a third piece of wire through the longitudinal center of said second spiral, inserting an end piece of said third piece of wire through said aperture in said handle, rotating said handle to curl said third piece of wire around said stem piece, and at the same time curl said first and second spirals around said stem piece to form a third spiral, removing said third spiral from said tool.

* * * * *